US006068550A

United States Patent [19]

Breitholtz et al.

[11] Patent Number: 6,068,550

[45] Date of Patent: May 30, 2000

[54] DEVICE AND METHOD FOR COIN PACKAGING

[75] Inventors: Claes Breitholtz, Lund; Jerry Karlsson, Malmö; Ulf Mossberg, Löddeköpinge, all of Sweden

[73] Assignee: Scan Coin AB, Malmo, Sweden

[21] Appl. No.: 08/990,771

[22] Filed: Dec. 15, 1997

[51] Int. Cl.[7] ..... G07D 9/04; G07D 1/00; B65B 1/08

[52] U.S. Cl. ..... 453/17; 453/21; 453/59; 453/62; 53/26; 53/499; 53/532; 53/537; 53/539

[58] Field of Search ..... 53/499, 498, 495, 53/537, 532, 254, 539, 260, 247; 453/21, 41, 17, 59, 61, 62

[56] References Cited

U.S. PATENT DOCUMENTS

| | | | |
|---|---|---|---|
| 757,612 | 4/1904 | Gilfillan | 53/254 |
| 781,324 | 1/1905 | White | 453/62 |
| 1,406,958 | 2/1922 | Abbott | 453/61 |
| 3,347,016 | 10/1967 | Silverman | 53/254 |
| 3,545,164 | 12/1970 | Middleton | 53/539 |
| 5,142,847 | 9/1992 | Watanabe et al. . | |
| 5,329,749 | 7/1994 | Yamamoto et al. | 53/532 |
| 5,499,944 | 3/1996 | Weston et al. | 453/17 |

FOREIGN PATENT DOCUMENTS

| | | |
|---|---|---|
| 508 448 | 10/1920 | France . |
| 1 201 590 | 9/1965 | Germany . |
| 26 25 698 | 12/1977 | Germany . |
| 2 026 989 | 2/1980 | United Kingdom . |
| WO 92/11953 | 7/1992 | WIPO . |

*Primary Examiner*—Robert P. Olszewski
*Assistant Examiner*—Bryan Jaketic
*Attorney, Agent, or Firm*—Burns, Doane, Swecker & Mathis, L.L.P.

[57] ABSTRACT

A coin packaging device has a table, to which a mass of coins of identical denomination may be supplied, and a plurality of cylinders, each cylinder being arranged to receive coins one by one through an open end, thereby stacking a predetermined number of coins thus received into a pile of coins. Furthermore, the device has means for distributing the coins across the table. The table is provided with a plurality of openings large enough for allowing the coins to pass therethrough. The open end of each respective cylinder is arranged to receive coins from a respective one of the openings in the table.

19 Claims, 10 Drawing Sheets

DEVICE AND METHOD FOR COIN PACKAGING

TECHNICAL FIELD

The present invention relates to a coin packaging device, comprising a table, to which a mass of coins of identical denomination may be supplied, and a plurality of cylinders, each cylinder being arranged to receive coins one by one through an open end, thereby stacking a predetermined number of coins thus received into a pile of coins. Furthermore, the present invention relates to a method of packaging a plurality of coins into piles and to the use of such a device in a self-serviced coin sorting machine.

DESCRIPTION OF THE PRIOR ART

Coin handling machines are used in a variety of applications for receiving a mass of coins from a user (e.g. a shop assistant or bank personnel) and for counting and/or sorting the coins thus received. Once the coins have been processed by the machine, e.g. sorted into coin boxes containing coins of identical denomination, the coins will have to be packed into piles or staples contained in a wrapping of paper or plastics. The common approach is to stack the coins in paper tubes, which are sealed at both ends once they have been completely filled with a predetermined number of coins. Previously known coin packaging machines are disclosed in for instance U.S. Pat. No. 5,142,847, GB-A-2 026 989 and DE-A-26 25 698. These coin packaging machines have a common limitation in that the coin tubes are produced in a serial manner, e.g. one coin tube at the time. Obviously, such serial processing has drawbacks as regards low throughput, a substantial amount of manual work, etc.

DE-B-1 201 590 discloses a coin packaging device, comprising a plane plate for receiving a plurality of coins of identical denomination. A row of cylinders, which are sealed at a first lower end and are open at a second upper end, are arranged in connection to a longitudinal edge of the plate. The plate is arranged in a downward slope towards the cylinders, so that the coins deposited on the plane plate will slide down the plate and through the open ends of the cylinders. The coins are stacked inside each cylinder, and when the cylinders are filled with coins, one longitudinal half of each cylinder may be swung open from a respective second longitudinal cylinder half, thereby allowing the pile of coins to be removed from the cylinder and put into e.g. a paper tube.

In such a machine, since the coins will have to rely on a passive sliding transport across the plane plate to the row of cylinders, there is an apparent risk of coin clogging or jamming, which may only be relieved by a manual operation of a human user. Furthermore, no measures are taken for assuring that the coins are uniformly distributed in each of the cylinders, which may give rise to situations, where one of the cylinders has been completely filled and another cylinder is only partly filled.

The need for an automated coin packaging device is particularly pronounced for so-called cash deposit systems, i.e. self-serviced coin handling machines, where an untrained user (e.g. a shop customer) may deposit a mass of coins of mixed denominations, for instance originating from his pocket, wallet or savings-box. The coins are put by the user into a coin intake in the machine, and the user then initiates the coin processing by pressing a start button or the like. Such a cash deposit system comprises a coin counting and sorting device as well as a display and a key pad for user interaction. Once the machine has completed the coin counting and sorting process, a receipt or voucher is printed out by a printer device contained in the machine. The user will then take the receipt and may use it as payment for articles offered in the shop.

The mass of coins deposited to the machine by a user are stored in different coin boxes contained inside the machine depending on the denomination of each coin. The coin boxes are regularly collected and emptied by authorized personnel. Since the shop itself will in most cases be able to use the coins received through the cash deposit system as small change coins at the cash-desks or check-out counters, the coins will not have to be transported away from the shop. However, to facilitate the handling of small change coins at the check-out counters, the coins will have to be provided as packages in the form of paper tubes or the like. Hence, for shops using a cash-deposit system there is a need for a coin packaging device, which may operate at a fairly high speed and on an automatic basis so as to pack the coins into appropriate packages with no or very little manual work involved.

SUMMARY OF THE INVENTION

A first object of the present invention is to provide a coin packaging device, which is able to process a large number of coins per time unit and produce a plurality of coin packages in parallel.

A second object of the present invention is to provide a coin packaging device, which may be made in a compact size and may be operated with no or very little manual work involved.

A third object of the present invention is to provide a coin packaging device, which may fit in an existing coin handling machine of a self-service or cash deposit type.

The above-mentioned objects of the present invention are achieved by providing a coin packaging device with a table, to which a mass of coins of identical denomination may be supplied, and a plurality of cylinders, each cylinder being arranged to receive coins one by one through an open end, thereby stacking a predetermined number of coins thus received into a pile of coins, wherein the table is provided with a plurality of openings, which are large enough for allowing the coins to pass therethrough, said open end of each respective cylinder being arranged to receive coins from a respective one of said openings in said table, and wherein the coin packaging device is further provided with means for distributing the coins across the table.

Other objects, features and merits of the invention appear from the following detailed disclosure of a preferred embodiment, from the claims as well as from the appended drawings.

BRIEF DESCRIPTION OF THE DRAWINGS

The present invention will now be described in more detail, reference being made to the accompanying drawings, in which.

DETAILED DISCLOSURE OF A PREFERRED EMBODIMENT

Starting from FIG. 3 a coin packaging device 10 according to a preferred embodiment of the invention will be described on a modular basis. Then, with reference to FIGS. 1 and 2, the use of two such coin packaging devices 10 in an automatic tubing unit 1 for a cash deposit system will be discussed.

The overall structure of the coin packaging device 10 is as follows.

A vibrator table is arranged at the upper side of the coin packaging device 10. The vibrator table comprises a plate with vertically projecting edges at all four sides. The plate is provided with a plurality of openings, the diameter of which is selected so as to allow coins deposited on the vibrator table to fall down through the openings. Furthermore a directed fibre carpet is attached to the vibrator table. When vibrations are generated in the vibrator table, the directed fibre carpet enhances the distribution and circulation of the coins across the vibrator table.

A deflection mechanism is arranged immediately below the vibrator table, comprising a buffer layer and a shear plate, both of which are provided with a plurality of openings corresponding to the plurality of openings in the vibrator table. The thickness of the buffer layer is selected to allow temporary storage of up to 5–10 coins in each of its cylinder-shaped openings, while the shear plate is thinner and may only contain one coin in each opening. When a sufficient number of coins have fallen down from the vibrator table and into the respective open cylinders in the buffer layer, the shear plate is displaced in a longitudinal direction, thereby bringing the openings in the shear plate as well as the coins contained therein into alignment with a corresponding set of cylinders in an underlying coin tube storage box.

The storage box is arranged immediately below the deflection mechanism. The storage box is provided with a plurality of cylinders extending vertically through the box. The number of cylinders corresponds to the number of openings in the vibrator table, the number of openings in the buffer layer and the number of openings in the shear plate. Paper tubes are provided in each of the storage box cylinders. The coin tube storage box is provided with means for facilitating the removal thereof from the coin packaging device, once the coin tubes are filled.

Figure 3:
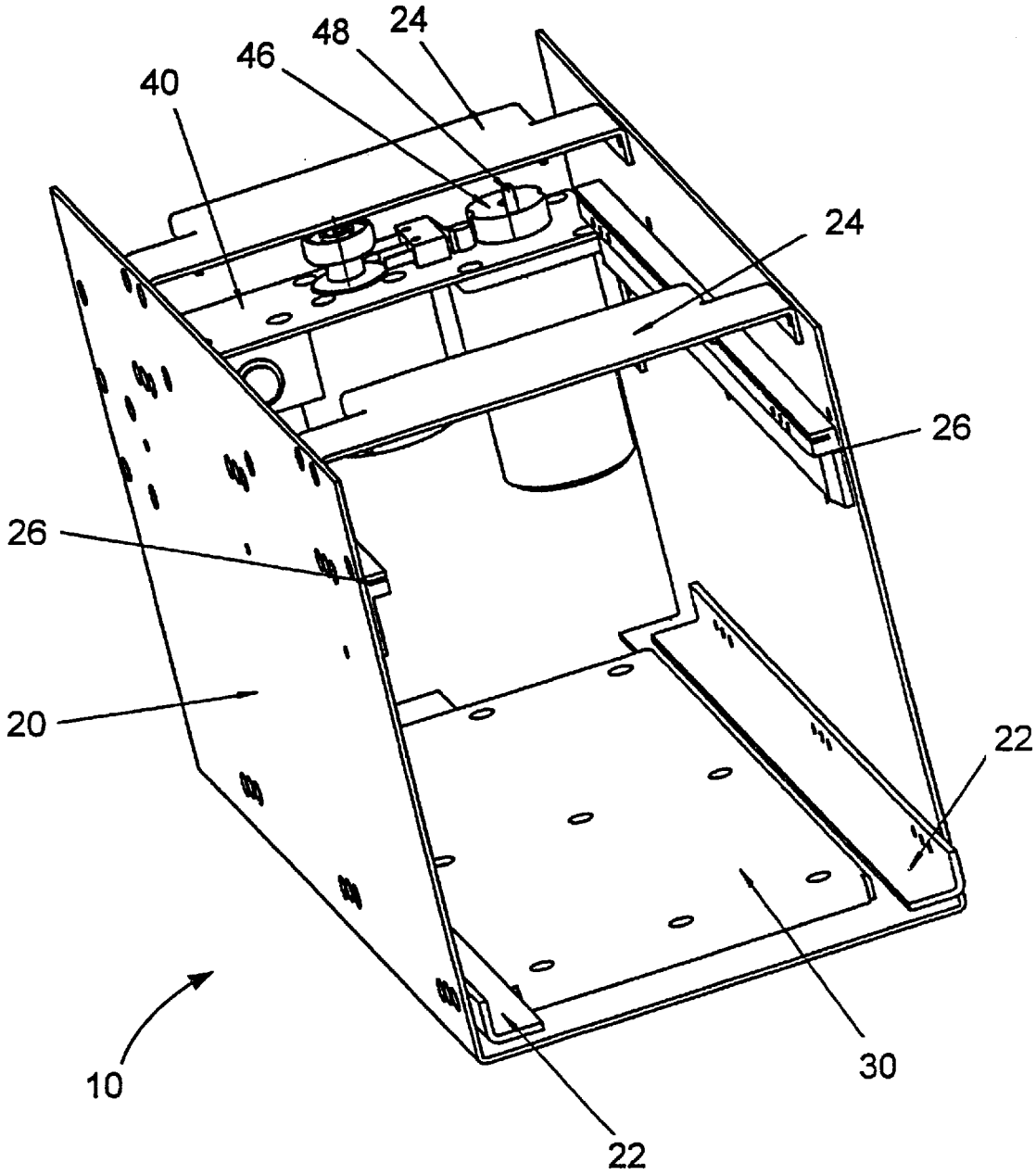
FIG. 3 is a perspective view of a frame structure and a drive assembly in a coin packaging device according to the preferred embodiment.
Figure 7:
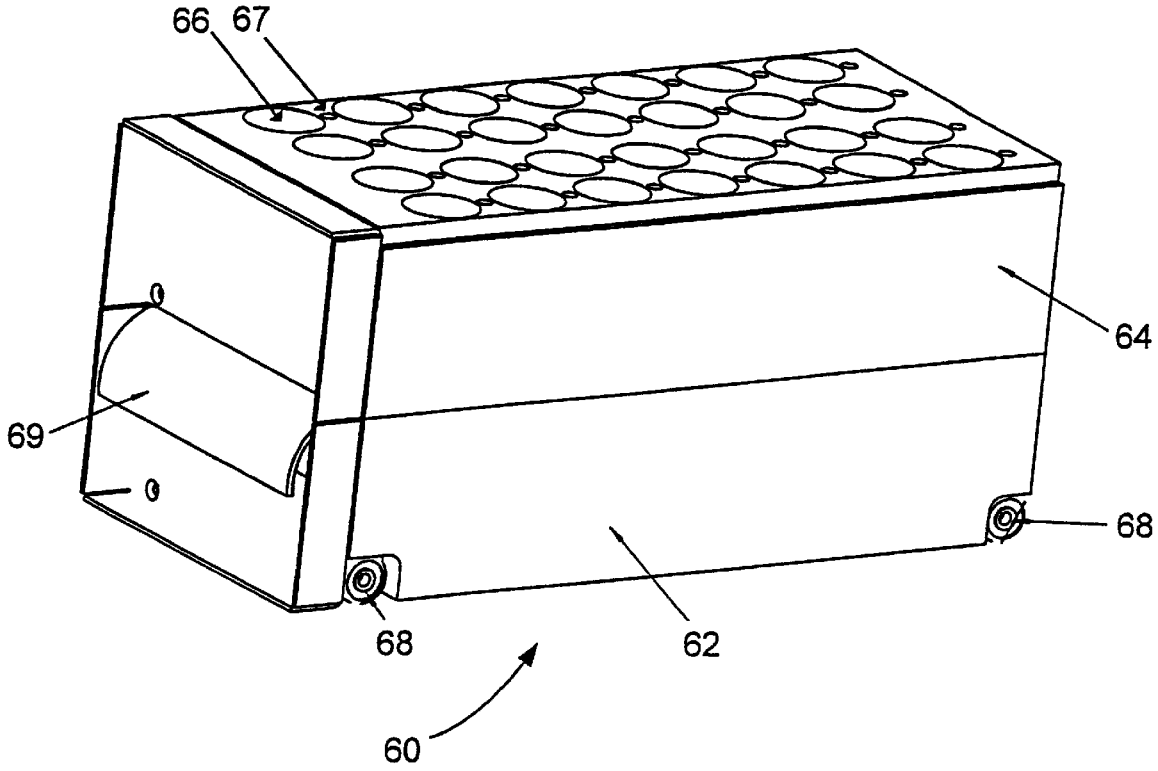
FIG. 7 is a detailed perspective view of the storage box in FIG. 6.

As shown in FIG. 3, the coin packaging device 10 comprises a frame 20, which is made of metal or any similar material. At its lower interior portion the frame 20 is provided with a pair of roller rails 22, by means of which the coin tube storage box (referred to as 60 in FIG. 7) may be removed from the coin packaging device 10. At the bottom of the frame 20, between the roller rails 22, a printed circuit board 30 is arranged. The printed circuit board 30 comprises a plurality of optical sensors, the function and purpose of which will be described in more detail later.

Figure 4:
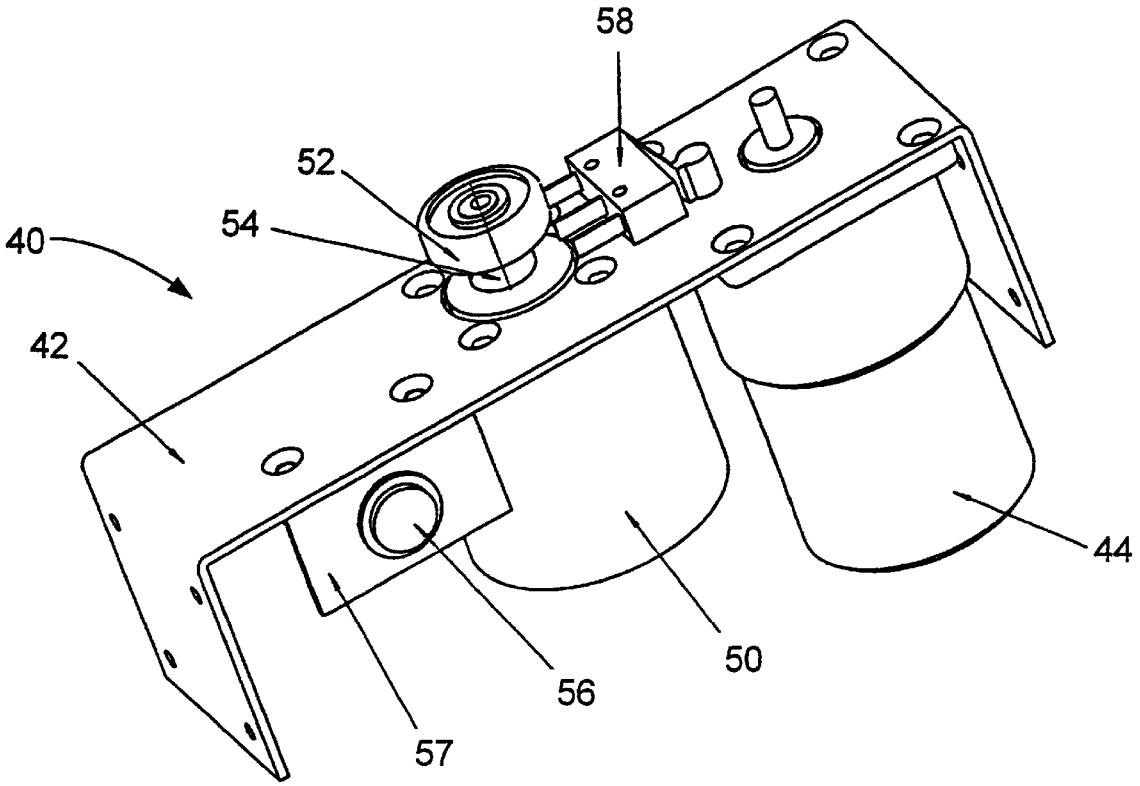
FIG. 4 is a detailed perspective view of the drive assembly in FIG. 3.

The frame 20 is provided with two stabilizer rails 24 at the upper portion thereof. Furthermore, a pair of skid rails 26 are mounted opposite each other on the interior surfaces of the vertical portions of the frame 20. The purpose of the skid rails 26 is to guide the shear plate (referred to as 70 in FIG. 9) during the displacement thereof between its first and second positions. At the rear portion of the coin packaging device 10 (as viewed in FIG. 3) a drive assembly 40 is arranged. As appears particularly from FIG. 4, the drive assembly 40 comprises a shear motor 44 and a vibrator motor 50, both of which are mounted to a drive assembly frame 42.

The purpose of the shear motor 44 is to drive a shear eccentric 46 and a guide pin 48 (see FIG. 3) so as to displace the shear plate 70 from its first position to its second and from its second position back to its first position, as will be described in more detail below. The shear eccentric 46 is made from aluminium. The eccentricity of the shear eccentric 46 is equal to one half of the displacement of the shear plate 70 between its first and its second positions. For a coin opening arrangement according to the preferred embodiment the eccentricity of the shear eccentric 46 may be about 8 mm.

The purpose of the vibrator motor 50 is to generate vibrations in the vibrator table (referred to as 90 in FIG. 12) so as to cause a directed force on the mass of coins deposited on the vibrator table, thereby moving the coins in one direction, as described below.

A vibrator eccentric 54 and a vibrator ball bearing 52 are mounted on a motor shaft of the vibrator motor 50. The eccentricity of the vibrator eccentric 54 may be for instance 0.5 mm. A retaining magnet 56 is mounted to a magnet bracket 57 and has the purpose of keeping the coin tube storage box 60 in a steady position inside the coin packaging device 10. Without any means for securing the storage box inside the coin packaging device during the operation thereof, the vibrations in the vibrator table would possibly cause undesired movements of the storage box in relation to the vibrator table, the shear plate and the buffer layer (referred to as 80 in FIG. 10). A microswitch 58 is arranged to detect the position of the shear motor 44, or specifically the first and second positions of the shear plate 70, thereby providing an opportunity to notice malfunctions due to e.g. the shear plate 70 getting stuck or jammed.

Figure 5:
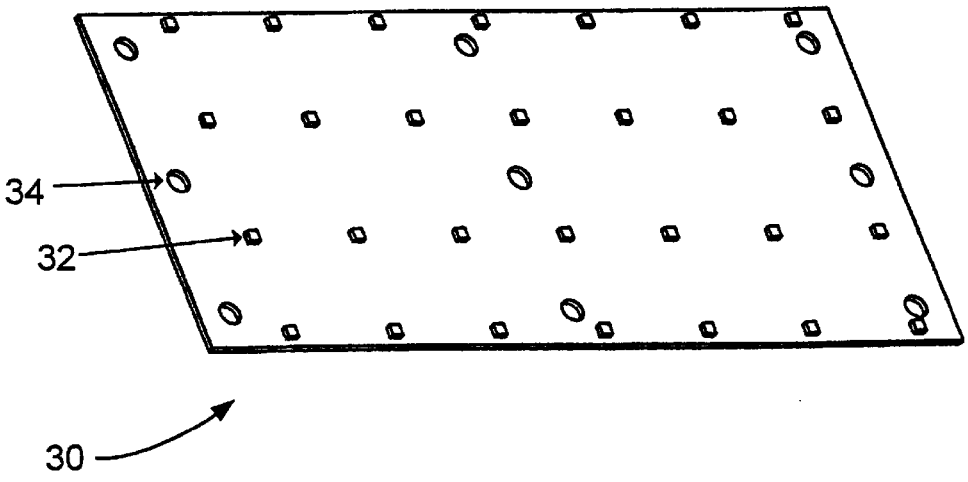
FIG. 5 is a perspective view of a printed circuit board located at the bottom of the frame structure in FIG. 3.

As shown in FIG. 5, the printed circuit board 30 comprises a plurality of optical sensors 32. The sensors 32 are transceivers of electromagnetic radiation, such as infrared light. The number of optical sensors 32 as well as the relative positions with respect to each other correspond to the two-dimensional arrangement of the openings in the vibrator table 90, the buffer layer 80, the shear plate 70 and a plurality of detector channels provided in the coin tube storage box 60, which will be described in more detail below. Each optical sensor is operatively connected to a controller not disclosed in the drawings and is arranged to transmit a beam of light in a vertical direction through the respective detector channel in the storage box 60 to a respective opening in the shear plate 70. If a coin is present in this opening, the light-beam emitted by the optical sensor 32 will be reflected back to the optical sensor 32, which acts as an opto-electrical transducer (e.g. a photodiode) and may hence convert the reflected light into an electric signal, which is supplied to the controller as an indication of the presence of the coin in the respective shear plate opening.

Once all optical sensors 32 have reported presence of coins in all respective shear plate openings, the controller will supply a control signal to the shear motor 44 to activate the displacement of the shear plate 70, as will be described later. If, on the other hand, no coin is present in the respective shear plate opening, the lightbeam emitted by the optical sensor 32 will not be reflected and returned to the optical sensor 32. In other words the optical sensors 32, the detector channels in the storage box 60, and the openings in the shear plate 70, the buffer layer 80 and the vibrator table 90 are all vertically aligned and will thus all let the light-beam pass therethrough, if no coin is blocking the path of the lightbeam. For enhanced detection accuracy the controller may be arranged to activate the optical sensors 32 on a periodic basis and use the results from several measurements when deciding whether coins are present in all openings or not. The holes 34 in the printed circuit board 30 are for mounting purposes only. Furthermore, the printed circuit board 30 is provided with a transparent protective layer not disclosed herein so as to prevent dust from contaminating the sensor arrangement.

Figure 6:
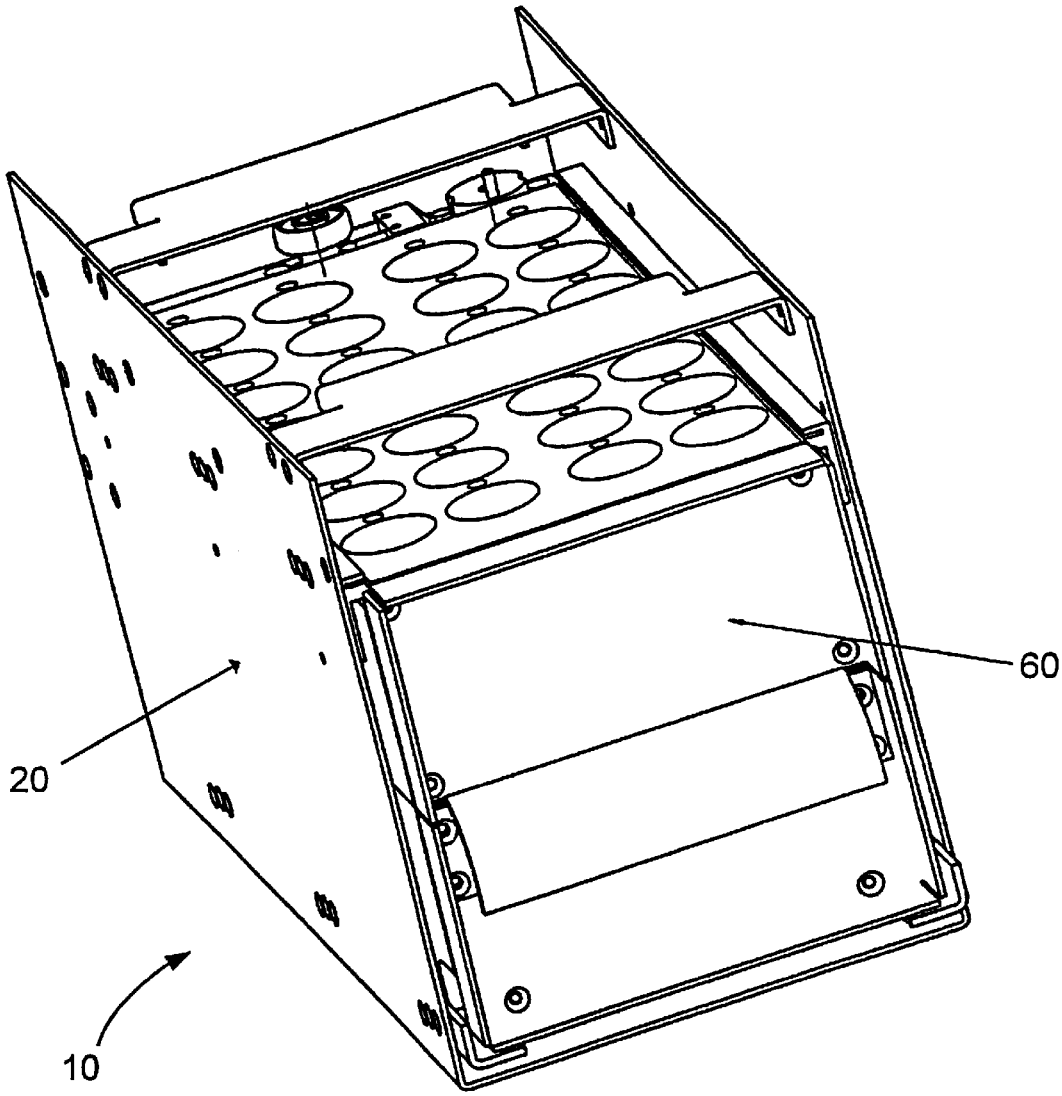
FIG. 6 is a perspective view of the preferred embodiment of the coin packaging device, where a storage box for housing a plurality of coin tubes has been added as compared to FIG. 3.

FIG. 6 illustrates the coin packaging device 10 with the coin tube storage box 60 mounted in its operational position inside the frame 20. The storage box 60 is illustrated in more detail in FIG. 7 and comprises a lower portion 62 and an upper portion 64, which are held together by a set of pins arranged at each corner on the top surface of the lower portion 62 and a corresponding set of holes provided at each corner of the bottom surface of the upper portion 64. The engagement between the pins and the holes are such that the upper portion 64 is prevented from moving in the horizontal direction relative to the lower portion 62, while the upper portion 64 may be removed in the vertical direction, i.e. lifted up, from the lower portion 62. The reason for dividing the coin tube storage box 60 into two portions 62 and 64 is that the insertion of empty paper tubes as well as the removal of filled paper tubes are facilitated. Both the lower portion 62 and the upper portion 64 are provided with a plurality of openings or bores extending through the entire upper portion 64 and a major part of the lower portion 62 in the vertical direction thereof, thereby forming the storage box cylinders 66 for housing the paper tubes. The cylinders 66 may have a slightly conical shape and are arranged to receive one paper tube each. Obviously, the diameter of the cylinders 66 must be slightly larger than the diameter of the coins, which are to be packaged by the device. The number and the two-dimensional arrangement of the cylinders 66 correspond to the arrangement of the shear plate openings 72, the buffer layer openings 82 and the vibrator table openings 92. However, the cylinders 66 are displaced a certain distance in one direction from the vibrator table openings 92, the buffer layer openings 82 as well as the shear plate openings 72, when the shear plate 70 is in its first position according to the above.

As previously described, the storage box 60 is provided with a plurality of detector channels 67 extending through the entire storage box 60 in the vertical direction thereof for admitting the respective lightbeams transmitted from the optical sensors 32 on the printed circuit board 30 to pass therethrough. To make it easier for a user to remove the storage box 60 from the coin packaging device 10, once the paper tubes in the cylinders 66 have been completely filled with coins, the storage box 60 is provided with a set of wheels 68, which may roll freely on the pair of roller rails 22, when a user pulls a handle 69 mounted on the front side of the coin tube storage box 60. On the rear side of the storage box 60 a magnetic counter element is arranged to be magnetically engaged with the magnet 56 (see FIG. 4) for securing the storage box 60 inside the coin packaging device 10 during the operation thereof.

Figure 9:
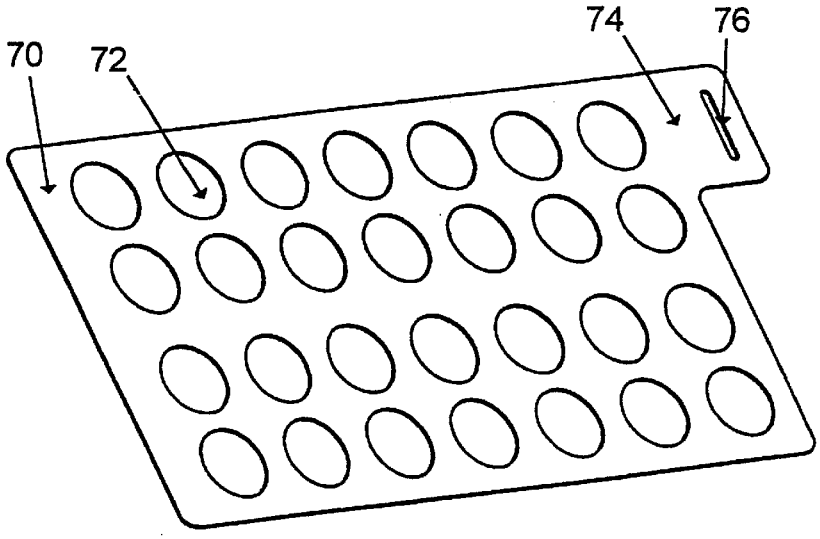
FIG. 9 is a detailed perspective view of the shear plate in FIG. 8.
Figure 8:
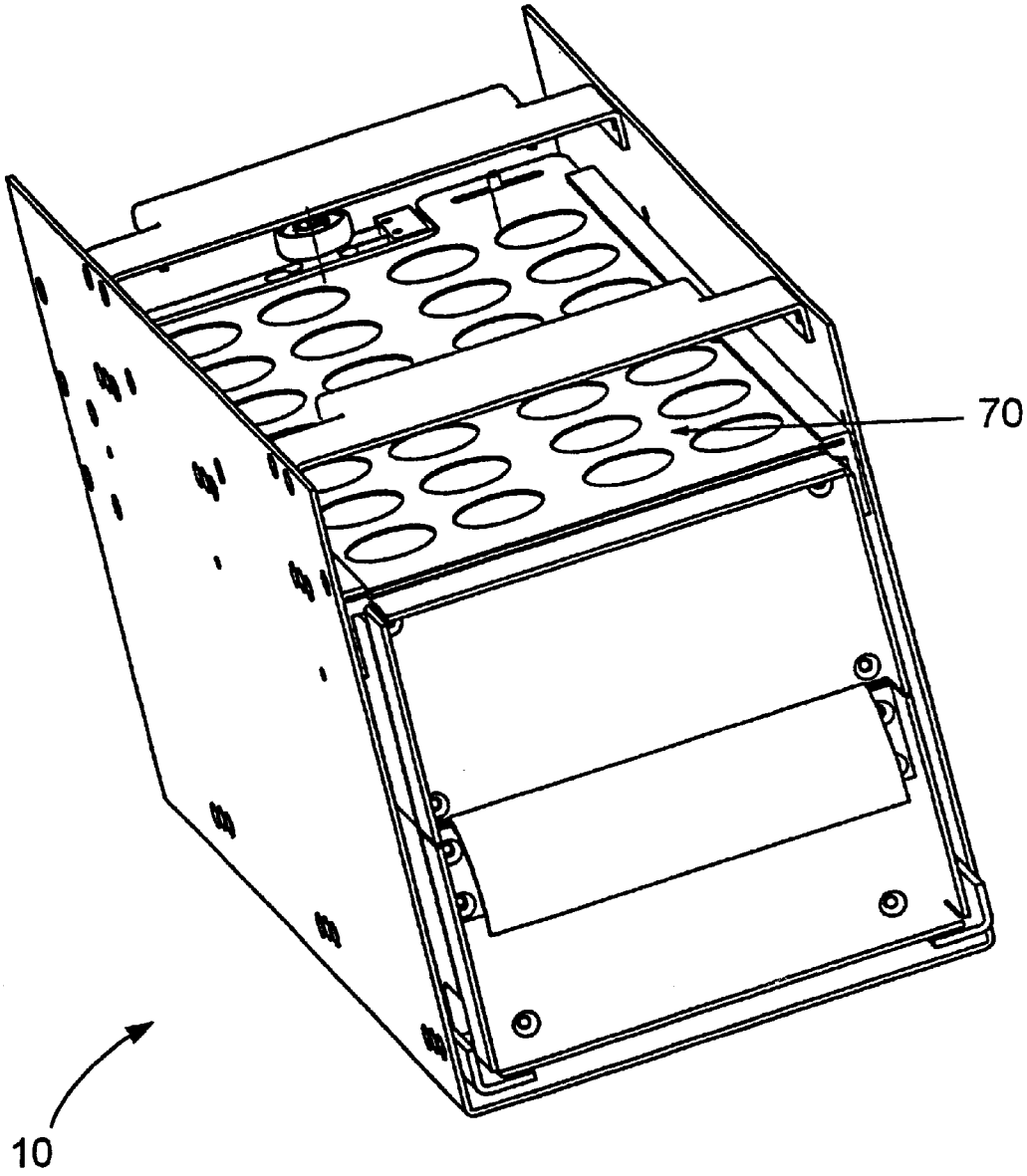
FIG. 8 is a perspective view of the coin packaging device, where a shear plate has been added as compared to FIG. 6.

FIG. 8 illustrates the mounting of the shear plate 70 in the coin packaging device 10. As shown in FIG. 8, the shear plate 70 rests in the pair of skid rails 26 previously described in connection with FIG. 3. The shear plate 70 comprises a plurality of openings 72, the number and two-dimensional arrangement of which correspond to the arrangement of the openings 82, 92 in the buffer layer 80 and the vibrator table 90, respectively, which will be described below. As shown in FIG. 9 the shear plate 70 comprises a tongue 74 with a groove 76. The groove 76 is arranged to receive the shear motor guide pin 48 (see FIG. 3). By the eccentric movement of the guide pin 48, the pin 48 will run back and forth in the groove 76. Furthermore, the guide pin 48 will periodically push and retract the shear plate 70 in a direction perpendicular to the groove 76, i.e. towards and away from the front of the coin tube storage box 60. The operational speed of the shear motor 44, and hence the frequency with which the guide pin 48 displaces the shear plate 70, is controlled by a controller not disclosed herein. When the shear plate 70 assumes its first position, i.e. to the rear of FIG. 8, the shear plate openings 72 are in vertical alignment with the corresponding openings 82, 92 in the buffer layer 80 and the vibrator table 90. When the shear plate 70 is displaced to its second position, the openings 72 are in vertical alignment with the cylinders 66 in the coin tube storage box 60.

Figure 10:
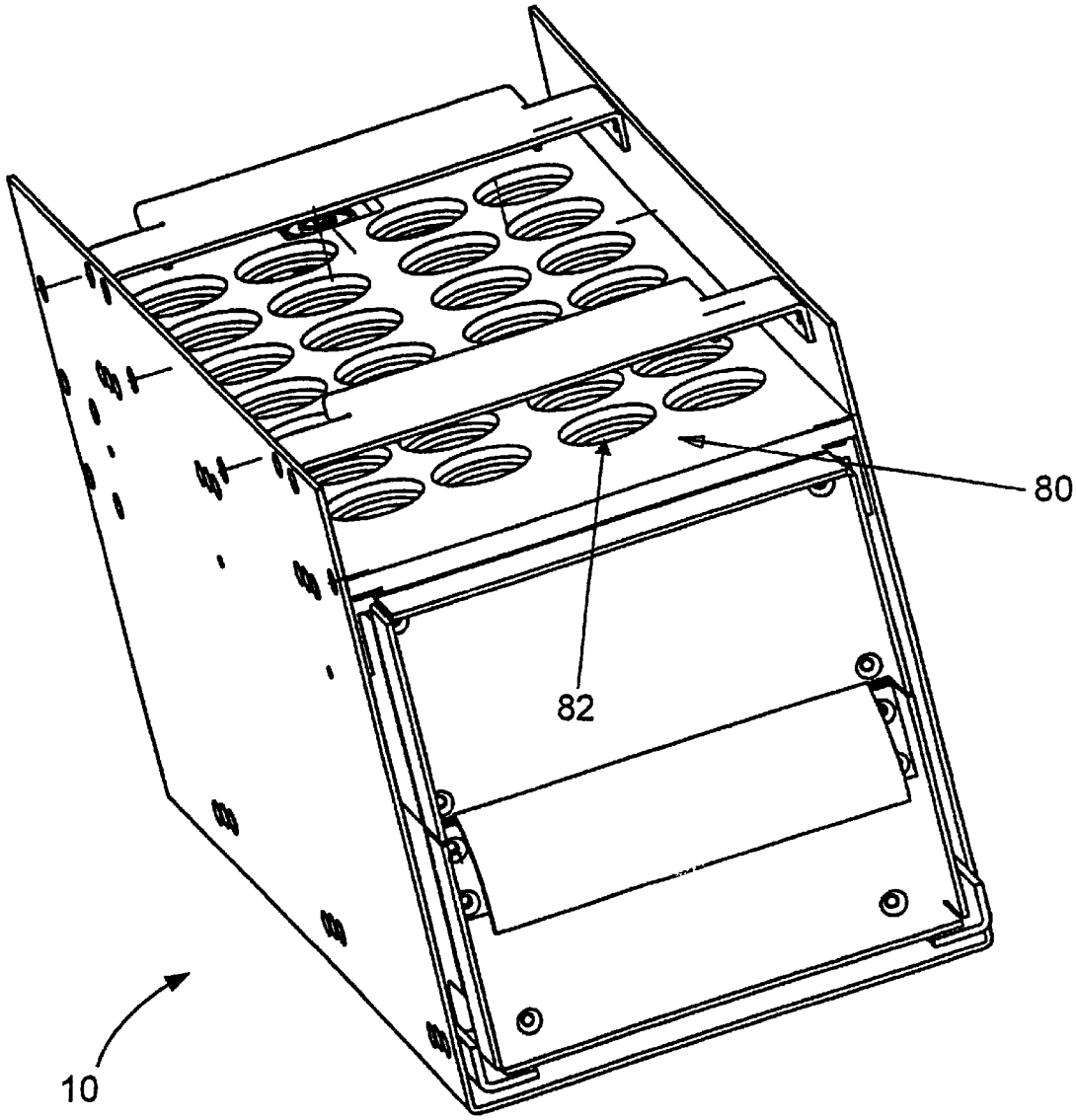
FIG. 10 is a perspective view of the coin packaging device, where a buffer layer has been added as compared to FIG. 8.

In FIG. 10 the coin packaging device 10 is illustrated with the buffer layer 80 in place. The buffer layer 80 has an essentially rectangular shape and is made of for instance a plastic material. At the rear end thereof (as viewed in FIG. 10) the buffer layer 80 is provided with a rectangular cut-in portion for allowing the vibrator ball bearing 52 (disclosed in FIGS. 3 and 4) to reach contact with the vibrator table. In correspondence with the shear plate 70 and the vibrator table 90 the buffer layer 80 is provided with a plurality of openings or holes, which have a circular cross-section and extend vertically through the buffer layer 80 in alignment with the center point of the vibrator table openings 92 and the detector channels 67 in the storage box 60. The buffer layer 80 has two main purposes, the first of which is to ensure a reliable deflection of only one single coin located in a respective shear plate opening 72, when the shear plate 70 is displaced from its first position to its second position by means of the shear motor 44. The second purpose of the buffer layer is to act as a buffer for coins, which have fallen through the vibrator table openings 92 and are buffered in temporary piles inside the openings 82 in the buffer layer 80, thereby making the coin packaging process less dependent on a constant flow rate of coins into the various openings of the device. Thanks to the buffer layer 80 the likelihood of having a coin ready to be deflected in each shear plate opening 72 into a respective paper tube in the storage box cylinder 66 is increased, thereby allowing a more frequent displacement of the shear plate 70. Tests have indicated that the thickness of the buffer layer 80 should be such that 5–7 coins of medium thickness should fit in a pile in each buffer opening 82. A subsidiary purpose of the buffer layer is to act as a support for the vibrator table 90.

Figure 11:
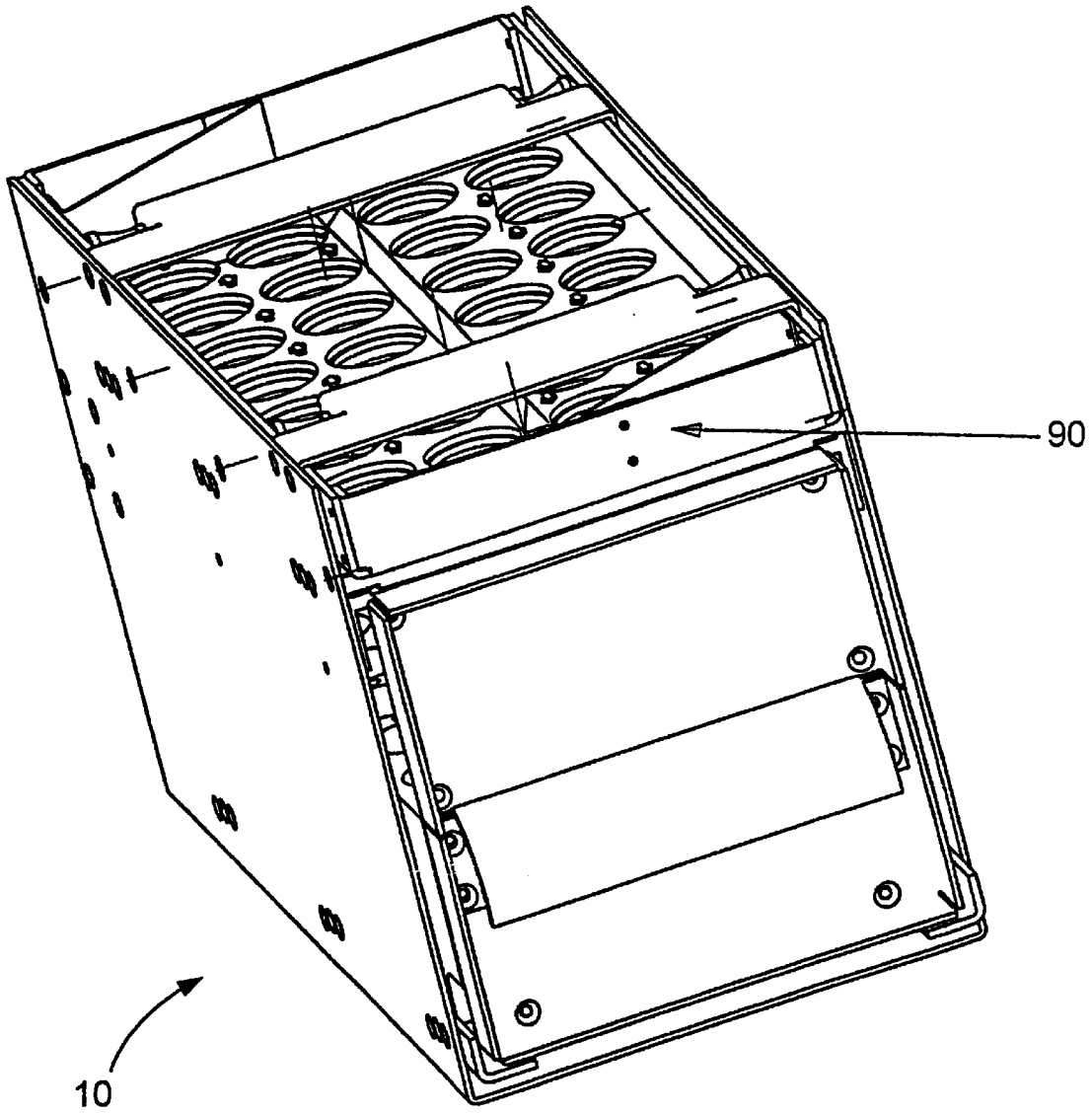
FIG. 11 is a perspective view of the coin packaging device, where a vibrator table has been added as compared to FIG. 10.
Figure 12:
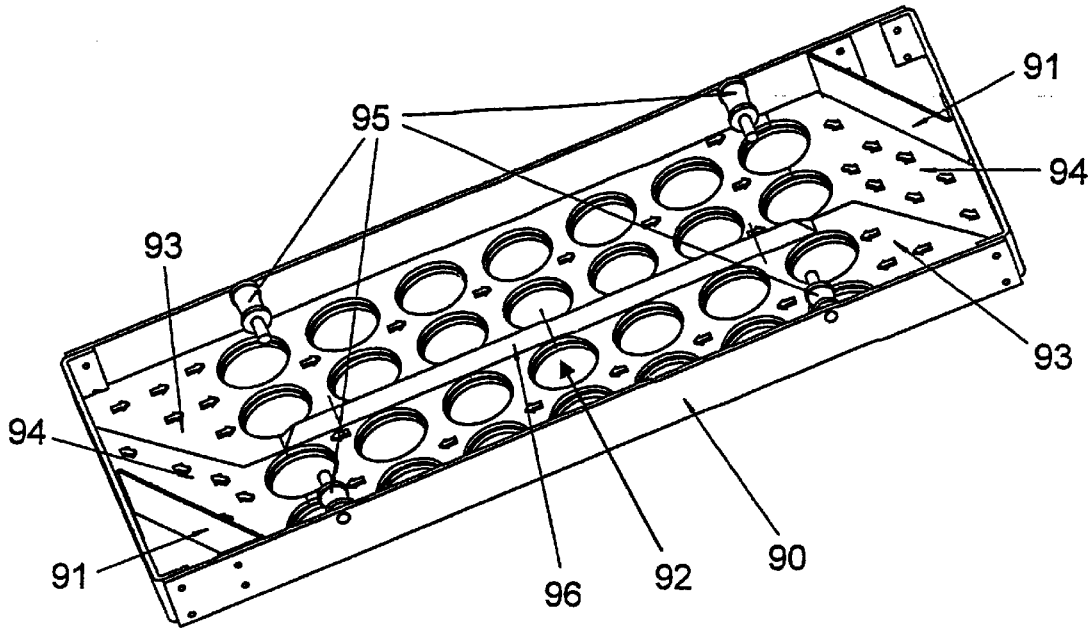
FIG. 12 is a detailed perspective view of the vibrator table of FIG. 11.
Figure 13:
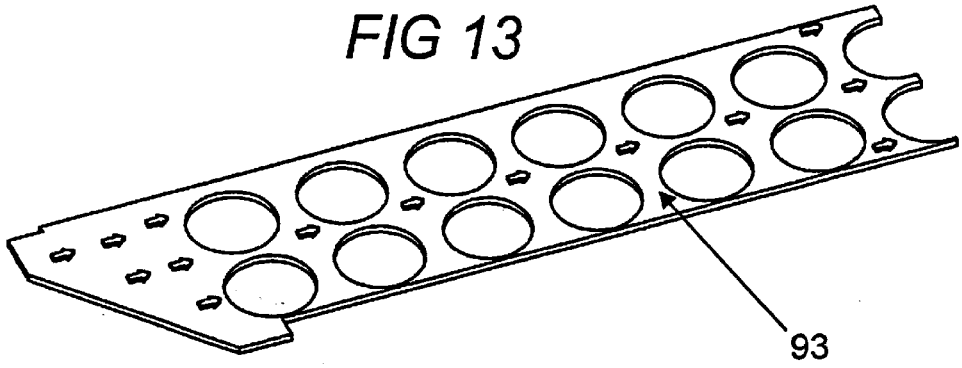
FIG. 13 is a detailed perspective view of a first portion of a directed fibre carpet contained in the vibrator table of FIG. 12.
Figure 14:
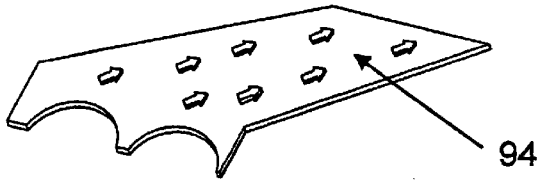
FIG. 14 is a detailed perspective view of a second portion of a directed fibre carpet contained in the vibrator table of FIG. 12.

FIG. 11 illustrates the coin packaging device 10 with the vibrator table 90 in its position at the uppermost part of the device. The vibrator table 90 is illustrated in a detailed view in FIG. 12 and comprises a plate provided with vertically projecting edges at all four sides thereof. At two diametrically opposite corners the vibrator table 90 is provided with borders 91, which are arranged at an angle to a respective longer and shorter edge of the vibrator table 90. The purpose of the angled borders 91 is to guide the mass of coins, so that they will not get stuck in one of the corners but instead maintain an endless flow on the surface of the vibrator table 90, as indicated by a plurality of directional arrows in FIG. 12. The upper surface of the vibrator table 90 is provided with a directed fibre carpet 93, 94, consisting of two long carpet portions 93 and two short carpet portions 94, which are illustrated in more detail in FIGS. 13 and 14. The four elements indicated as 95 in FIG. 12 are vibration absorbers for absorbing vibrations in the undesired directions, i.e. perpendicular to the direction of the coin flow on the table 90. On the rear or bottom surface of the vibrator table a vibration receiver (not disclosed) is mounted. The vibration receiver is arranged to receive vibrations generated by the vibration motor 50 and transfer these vibrations to the vibrator table 90.

A vibrator table divider 96 is arranged at the center of the vibrator table 90 in the longitudinal direction thereof. The divider 96 has the purpose of guiding the coin flow along the endless path, as indicated by the directed arrows in FIG. 12, and to prevent the coins from moving in an undesired direction perpendicular to the intended coin flow direction. Furthermore, the vibrator table divider 96 has a triangular cross-section so as to allow a minor portion of the coins to actually slide across the divider 96 from one half of the vibrator table 90 to the other, when and if a large number of coins have gathered in one area of the vibrator table 90, thereby preventing a bottle-neck situation from being developed. The vibrator table 90, the angled borders 91 and the divider 96 may be made from for instance aluminium plate.

The directed fibre carpet 93, 94 and the vibrator table 90 are provided with a plurality of openings 92, which are aligned with the corresponding plurality of openings 82 in the buffer layer 80 and the detector channels 67 in the coin tubes storage box 60. As previously described, the diameter of the openings 92 are large enough for allowing coins of a given denomination to fall down through the opening 92 when being driven across the opening during the directed flow around the table 90 caused by the vibrator motor 50, the vibrator eccentric 54 and the vibrator ball bearing 52. Thus, a mass of coins deposited on the vibrator table will be distributed across the entire surface of the vibrator table and be forced into an endless flow across all openings 92, thanks to the vibration generated in the table and the operation of the directed fibre carpet 93, 94. Once a coin passes immediately above an opening 92, it will fall down through the opening 92 and into the respective opening 82 in the buffer layer 80. If the particular opening 82 in the buffer layer as well as the underlying opening 72 in the shear plate 70 both are empty, the coin will fall down into the shear plate opening 72 but will be prevented from falling further, as long as the shear plate 70 is in its first or normal position. If there already exists one or a few coins in the shear plate opening 72 and the respective buffer layer opening 82, the coin will land on top of the uppermost coin, thereby forming a pile of coins. After some time of operation, all shear plate openings 72 will contain one coin each, as detected by the optical sensors 32, the controller then activating the shear motor 44 so as to displace the shear plate 72 to its second position, wherein the shear plate openings 72 are vertically aligned not with the vibrator table openings 92 but with the coin tubes in the storage box cylinders 66. Hence, the single layer of coins present in the shear plate openings 72 will be carried to a position, in which they will fall down into the respective coin tube to be stacked into a pile of coins therein.

The coin packaging device 10 may be provided with detector means for detecting whether all coin tubes in the storage box 60 have been completely filled with coins, thus containing a full pile of coins containing a predetermined number of coins. The coin packaging device will then be stopped, giving the user an opportunity to pull out the coin tube storage box 60, separate the storage box portion 62 and 64 and remove and seal the coin tubes stored therein. The user may then insert empty paper tubes in the storage box cylinders 66 and restart the operation of the coin packaging device 10.

Figure 1:
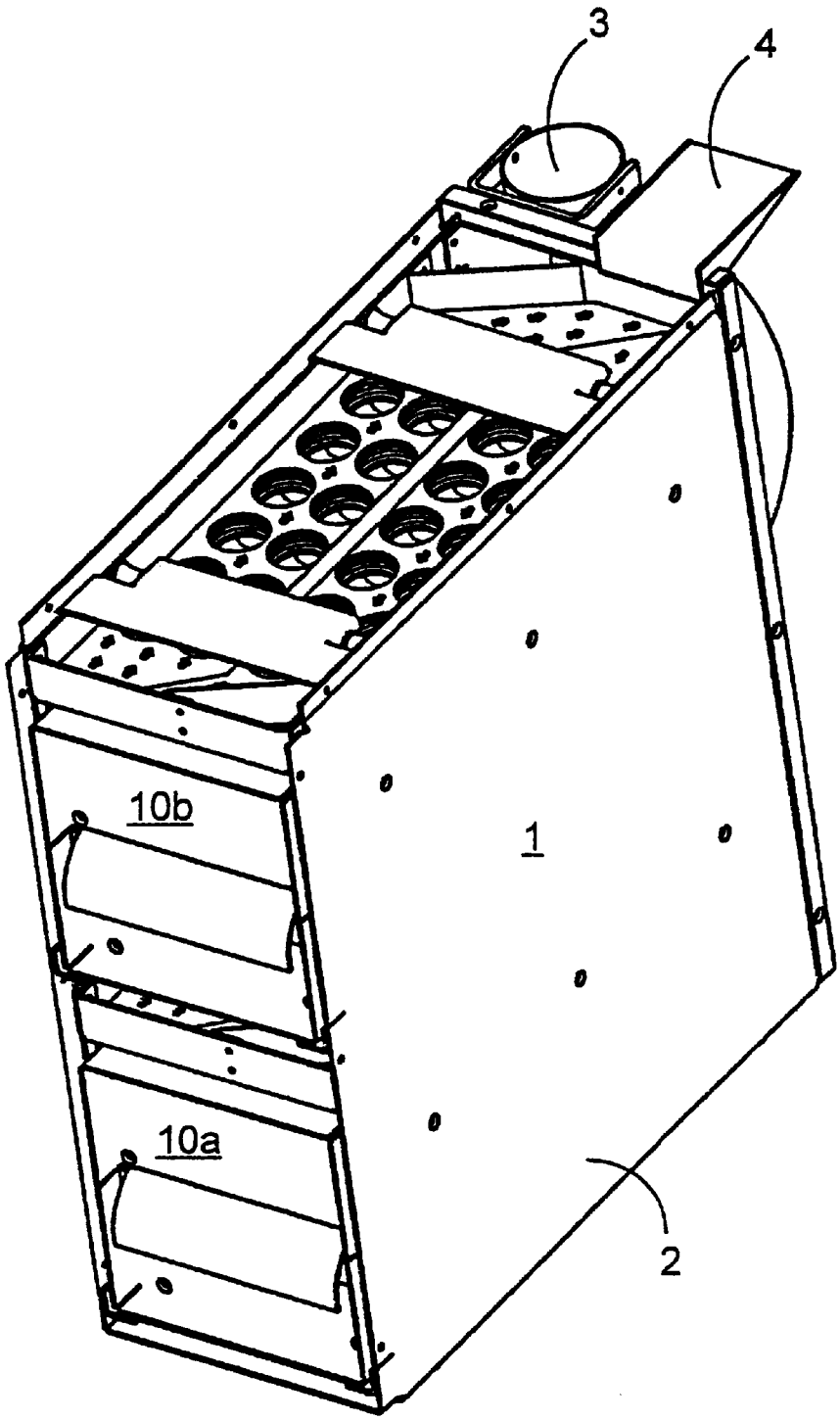
FIG. 1 is a perspective front view of an automatic tubing unit comprising two coin packaging devices according to a preferred embodiment of the present invention.
Figure 2:
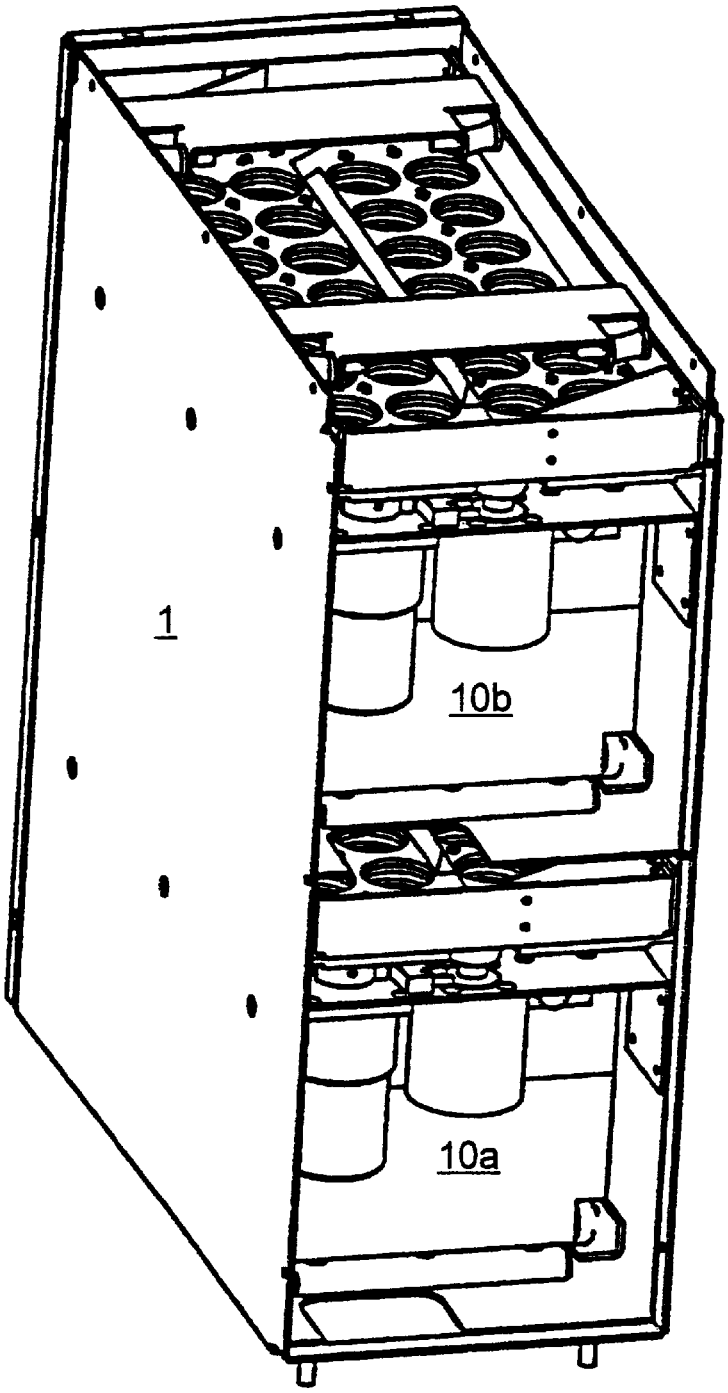
FIG. 2 is a perspective rear view of the automatic tubing unit of FIG. 1.

As previously mentioned, the coin packaging device 10 may be used in a cash deposit system, i.e. a self-serviced coin sorting machine. Preferably, as illustrated in FIGS. 1 and 2, two packaging devices 10 according to the invention are used in an automatic tubing unit 1. The automatic tubing unit 1 comprises a metal housing 2, a first coin packaging device 10*a* and a second coin packaging device 10*b*, the latter being arranged above the former. Furthermore, a first coin inlet 3 is arranged at the upper rear portion of the housing 2. The purpose of the coin inlet 3 is to receive a sorted mass of coins of identical denomination from the sorting device in the cash deposit system and supply the mass of coins to the vibrator table of the first coin packaging device 10*a*. The first coin inlet 3 is shaped as a bended tube extending along the vertical rear portion of the automatic tubing unit 1 to an opening, through which the mass of coins received at the upper end of the tubular coin inlet 3 may be deposited on the vibrator table of the lower coin packaging device 10*a* (see FIG. 2). A second coin inlet 4 is arranged next to the first coin inlet 3 at the upper rear portion of the housing 2. Correspondingly, the second inlet 4 is arranged to receive a sorted mass of coins of identical denomination from the sorting device of the cash deposit system, the mass of coins thereby sliding down the plane and inclined second coin inlet 4 to arrive at the vibrator table of the second coin packaging device 10*b*. For clarifying reasons the first and second coin inlets 3 and 4 have been omitted in the rear view of FIG. 2.

By the arrangement described above the automatic tubing unit 1 is made compact and provides high performance (since the unit comprises two coin packaging devices 10*a* and 10*b* operating simultaneously, both of which in themselves are high-performance devices) as well as a high automation level. The overall size and shape of the automatic tubing unit 1 is selected so that it may replace one or two conventional coin box(es) in a cash deposit system. As is well-known to a man skilled in the art, cash deposit systems normally comprise a number of coin storage boxes arranged next to each other on a trolley, the coin storage boxes as well as the trolley normally being hidden and protected behind a locked pair of cabinet doors. The coin boxes are arranged to receive the coins sorted and counted by the cash deposit system and to store the coins in a safe manner until an authorized person arrives to collect the coins. Hence, the automatic tubing unit 1 may replace e.g. one or two of these coin storage boxes, thereby giving the user an obvious advantage in that the coins will already be stacked into piles as well as packed in coin tubes, when the user is about to collect the coins from the cash deposit system. A further advantage of the automatic tubing unit 1 is that the two coin packaging devices 10*a* and 10*b* may be arranged to receive coins of different denominations, so that the automatic tubing unit 1 will be able to accept coins of two different denominations.

The description above of the coin packaging device according to the preferred embodiment of the invention is to be taken as an example only. The invention may be carried out in other ways than the one described within the scope of the inventive concept, as defined by the appended independent patent claims. For instance, the vibrator table may be provided with other means than the directed fibre carpet and the vibrator motor for distributing the coins across the table. The deflection operation of the coin packaging device may be carried out by other means than the buffer layer and the shear plate. The coin tube storage box may have another design than the one illustrated, and the coin sensor arrangement does not have to be located at the bottom of the device. One alternative would be to arrange the sensors proximate to the openings in the vibrator table, the buffer layer or the shear plate, so as to detect the passage of a coin, when it is falling down through the opening. The sensors may operate in a manner different than optical.

Specifically, the number, dimensions and structural arrangement of all coin openings in the coin packaging device may be varied in many different ways. Obviously, a man skilled in the art may easily modify the coin packaging device depending on the thickness, diameter, etc, of the type of coins to be packaged by the coin packaging device.

We claim:

1. A coin packaging device, comprising:

a plurality of cylinders, each cylinder being arranged to receive coins one by one through an open end, thereby stacking a predetermined number of coins thus received into a pile of coins;

a table having a top surface, to which a mass of coins of identical denomination may be supplied, said table being provided with a plurality of openings arranged in a two-dimensional array covering a major part of said top surface, the openings being large enough for allowing the coins to pass therethrough, wherein an open end of each respective cylinder is arranged to receive coins from a respective one of said openings in said table; and a vibrator coupled to said table and adapted to generate vibrations therein so as to distribute the coins across said two-dimensional array of openings in said table.

2. A coin packaging device according to claim 1, further comprising deflection means for preventing coins from entering the cylinders in a first position and for delivering coins to the cylinders in a second position.

3. A coin packaging device according to claim 1, further comprising buffer means for temporarily storing coins received through the openings in the table prior to the stacking thereof in the cylinders.

4. A coin packaging device according to claim 1, further comprising storage means containing the cylinders, in which the coins are stacked, the storage means being removable from the coin packaging device.

5. A coin packaging device according to claim 4, wherein the storage means is arranged to accommodate a paper tube in each cylinder.

6. A coin packaging device according to claim 5, wherein the storage means (60) has an upper portion and a lower portion, which may be separated from each other so as to facilitate the insertion of empty paper tubes and the removal of the paper tubes once filled with coins.

7. A coin packaging device according to claim 2, wherein the deflection means comprises a plurality of openings, the diameter of each opening being essentially equal to the diameter of the openings in the table.

8. A coin packaging device according to claim 3, wherein the buffer means comprises a plurality of openings, the diameter of each opening being essentially equal to the diameter of the openings in the table.

9. A coin packaging device according to claim 8, wherein the buffer means is arranged to temporarily store up to 5–10 coins in a pile in each opening.

10. A coin packaging device according to claim 7, wherein the deflection means is arranged to contain a maximum of one coin in each opening in the first position of the deflection means.

11. A coin packaging device according to claim 1, wherein the table comprises a directed fibre carpet adapted to receive vibrations from the vibrator and exert an essentially unidirectional force to the coins on the table.

12. A coin packaging device according to claim 1, wherein the table and vibrator are arranged to carry the coins along an endless path across the openings in the table.

13. A coin packaging device according to claim 1, further comprising sensor means for detecting the presence or absence of coins at predetermined positions in the coin packaging device.

14. A coin packaging device according to claim 13, wherein the sensor means are optoelectric sensors.

15. A coin packaging device according to claim 8 further comprising:

deflection means for preventing coins from entering the cylinders in a first position and for delivering coins to the cylinders in a second position, the deflection means comprising a plurality of openings having a diameter which is essentially equal to the diameter of the openings in the table; and storage means containing the cylinders in which the coins are stacked, the storage means being removable from the coin packaging device;

wherein the openings in the table and the openings in the buffer means are vertically aligned with the openings in the deflection means in the first position thereof, while the cylinders in the storage means are vertically aligned with the openings in the deflection means in the second position thereof.

16. A method of packaging a plurality of coins into piles containing a predetermined maximum number of coins, comprising the steps of:

receiving the plurality of coins on a top surface of a table having a plurality of openings arranged in a two-dimensional array covering a major part of the top surface;

distributing the coins across the two-dimensional array of openings by generating vibrations in the table;

receiving the coins, through the openings in the table, in a plurality of cylinders, so as to stack coins received through each opening into a respective pile of coins.

17. A method according to claim 16, wherein the coins are carried along an endless path across the openings.

18. A method according to claim 16, comprising the further step of temporarily storing coins received through the openings in the table prior to the stacking thereof in the cylinders.

19. A method according to claim 16, comprising the further steps of preventing coins received through the openings in the table from entering the cylinders by maintaining a deflection means in a first position and delivering the coins to the cylinders by displacing the deflection means to a second position.

* * * * *